US010756439B2

(12) United States Patent
Rankin et al.

(10) Patent No.: US 10,756,439 B2
(45) **Date of Patent: *Aug. 25, 2020**

(54) WIDE ANGLE PLANAR ANTENNA ASSEMBLY

(71) Applicant: Walmart Apollo, LLC, Bentonville, AR (US)

(72) Inventors: Stan Rankin, Springdale, AR (US); Brock Judd, Bentonville, AR (US); Mark Edwards, Centerton, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/209,369

(22) Filed: Dec. 4, 2018

(65) Prior Publication Data

US 2019/0109384 A1 Apr. 11, 2019

Related U.S. Application Data

(63) Continuation of application No. 15/430,048, filed on Feb. 10, 2017, now Pat. No. 10,181,651, which is a (Continued)

(51) Int. Cl.
*H01Q 15/14* (2006.01)
*H01Q 7/00* (2006.01)

(Continued)

(52) U.S. Cl.
CPC ..... *H01Q 15/14* (2013.01); *H01Q 1/38* (2013.01); *H01Q 7/00* (2013.01); *H01Q 19/18* (2013.01); *H01Q 21/061* (2013.01)

(58) Field of Classification Search
CPC ..... H01Q 15/14; H01Q 7/00; H01Q 19/18; H01Q 21/061; H01Q 1/38
See application file for complete search history.

(56) References Cited

U.S. PATENT DOCUMENTS 2,486,589 A 11/1949 Chu
2,625,655 A * 1/1953 Middlemark ..... H01Q 19/10 343/797

(Continued)

FOREIGN PATENT DOCUMENTS

CN 101958463 B 4/2013
CN 104051866 A 9/2014

(Continued)

OTHER PUBLICATIONS

International Search Report and Written Opinion for Application PCT/US14/20285 filed Mar. 4, 2014, dated Jul. 8, 2014, 7 pages.

(Continued)

*Primary Examiner* — Hoang V Nguyen
(74) *Attorney, Agent, or Firm* — McCarter & English, LLP

(57) ABSTRACT

Exemplary embodiments, the present disclosure are related to an antenna system including radiating elements and reflectors. The reflectors can be disposed with respect to the radiating elements to reflect radiation from the radiating elements to generate a coverage area that exceeds the coverage area generated by the radiating elements without the reflectors.

21 Claims, 15 Drawing Sheets

Related U.S. Application Data continuation of application No. 15/163,108, filed on May 24, 2016, now Pat. No. 9,601,834, which is a continuation-in-part of application No. 13/904,962, filed on May 29, 2013, now Pat. No. 9,515,389.

(60) Provisional application No. 61/799,322, filed on Mar. 15, 2013.

(51) Int. Cl.

| | |
|---|---|
| ***H01Q 19/18*** | (2006.01) |
| ***H01Q 21/06*** | (2006.01) |
| ***H01Q 1/38*** | (2006.01) |

(56) References Cited

U.S. PATENT DOCUMENTS

| | | | | |
|---|---|---|---|---|
| 3,742,512 | A | 6/1973 | Munson | |
| 5,398,035 | A * | 3/1995 | Densmore | H01Q 1/3275 343/713 |
| 7,215,294 | B2 | 5/2007 | Jocher | |
| 9,515,389 | B2 | 12/2016 | Rankin et al. | |
| 9,601,834 | B2 | 3/2017 | Rankin et al. | |
| 9,885,051 | B2 | 2/2018 | Curtiss, III et al. | |
| 10,181,651 | B2 * | 1/2019 | Rankin | H01Q 19/18 |
| 2004/0017958 | A1 | 1/2004 | Bradshaw | |
| 2005/0237258 | A1 | 10/2005 | Abramov et al. | |
| 2007/0195004 | A1 | 8/2007 | Rebeiz et al. | |
| 2007/0210974 | A1 | 9/2007 | Chiang | |
| 2010/0231464 | A1 | 9/2010 | Huang et al. | |
| 2012/0098725 | A1 | 4/2012 | Lytle et al. | |
| 2014/0266956 | A1 | 9/2014 | Rankin et al. | |
| 2016/0344106 | A1 | 11/2016 | Rankin et al. | |

FOREIGN PATENT DOCUMENTS

| | | | |
|---|---|---|---|
| GB | 2132022 | A | 6/1984 |
| GB | 2331185 | A | 5/1999 |
| JP | H10-31062 | A | 2/1998 |
| JP | 2010-154182 | A | 7/2010 |

OTHER PUBLICATIONS

International Preliminary Report on Patentability for Application No. PCT/US2014/020285, dated Sep. 15, 2015, 5 pages.

United Kingdom Office Action for Application No. GB1516338.9, dated Jul. 31, 2017. 6 pages.

United Kingdom Office Action for Application No. GB1708283.5, dated Sep. 15, 2017. 5 pages.

United Kingdom Office Action for Application No. GB1516338.9, dated Nov. 15, 2017. 4 pages.

United Kingdom Office Action for Application No. GB1516338.9, dated Feb. 8, 2018. 2 pages.

United Kingdom Office Action for Application No. GB 1708283.5, dated Jul. 30, 2019. 6 pages.

Examination Report from related Great Britain patent application No. GB1708283.5 dated Jan. 20, 2020.

* cited by examiner

WIDE ANGLE PLANAR ANTENNA ASSEMBLY

CROSS REFERENCE TO RELATED APPLICATIONS

This application is a continuation of and claims benefit of priority to U.S. patent application Ser. No. 15/430,048 filed Feb. 10, 2017, which is a continuation of U.S. Pat. No. 9,601,834 filed May 24, 2016, which is a continuation-in-part of and claims the benefit of priority to U.S. Pat. No. 9,515,389 filed on May 29, 2013, which claims the benefit of priority to U.S. Provisional Application No. 61/799,322, entitled "Wide Angle Planar Antenna Assembly," filed on Mar. 15, 2013. The contents of each application are hereby incorporated by reference in their entirety.

BACKGROUND

Exemplary embodiments of the present disclosure relate to an antenna assembly and more particularly to a wide angle loop antenna assembly that provides a wireless communications coverage area according to a radiation pattern generated by the antenna assembly that addresses one or more dead zones of individual antennas in the antenna assembly.

Conventionally, antennas can provide for wireless coverage areas according to their radiation pattern. Often, depending on the type of antenna used, the radiation pattern of the antenna can include one or more null or dead zones within which no radiation from the antenna can be detected/measured. This can become an issue when attempting to provide consistent wireless communication coverage of a geographic zone.

In recent years, business entities have been installing wireless communication access zones (e.g., WiFi hotspots) to allow customers to access a communications network using their portable communications devices (e.g., mobile phones). It can be challenging for entities to provide an antenna solution that satisfies level of service criteria and reduce or eliminate radiation pattern dead zones to provide the customers with a robust communications signal with a specified geographic zone. For example, a retail entity may wish to establish a wireless communication zone in a geographic zone (e.g. a store parking lot) by mounting an antenna or antenna assembly to the exterior of the building. Due to the height of many buildings occupied by business entities and the radiation pattern dead zones, it can be difficult to provide a wireless coverage zone that extends beyond the proximity of the exterior of the building.

Wireless coverage only near the exterior of a building can present some problematic conditions. For example, a user may be able to connect wirelessly to the antenna while in close proximity to a building entrance, but the signal strength degrades to a degree such that the user can lose the wireless connectivity as he/she walks away from the store.

SUMMARY

In accordance with embodiments of the present disclosure, exemplary antenna systems including radiating elements and reflectors are provided. The reflectors can be disposed with respect to the radiating elements to reflect radiation from the radiating elements to generate a coverage area that exceeds the coverage area generated by the radiating elements without the reflectors.

In accordance with embodiments of the present disclosure, an exemplary antenna system including a plurality of radiating elements aligned in a common plane is provided. The antenna system includes a first reflector centrally located with respect to the radiation elements in a radiation direction of the radiation elements away from the plane.

In accordance with embodiments of the present disclosure, an exemplary antenna system includes a plurality of radiation elements having a quadrant arrangement and being disposed in a common plane and circumferentially about an axis perpendicular to the common plane. The antenna system includes a conical reflector having an apex, a base, and a conical surface, wherein the apex of the conical reflector is disposed in proximity and centrally with respect to the radiating elements. The base is disposed away from the radiating elements, and the conical surface extends from the apex to the base at a first angle with respect to the common plane.

DETAILED DESCRIPTION

Figure 1:
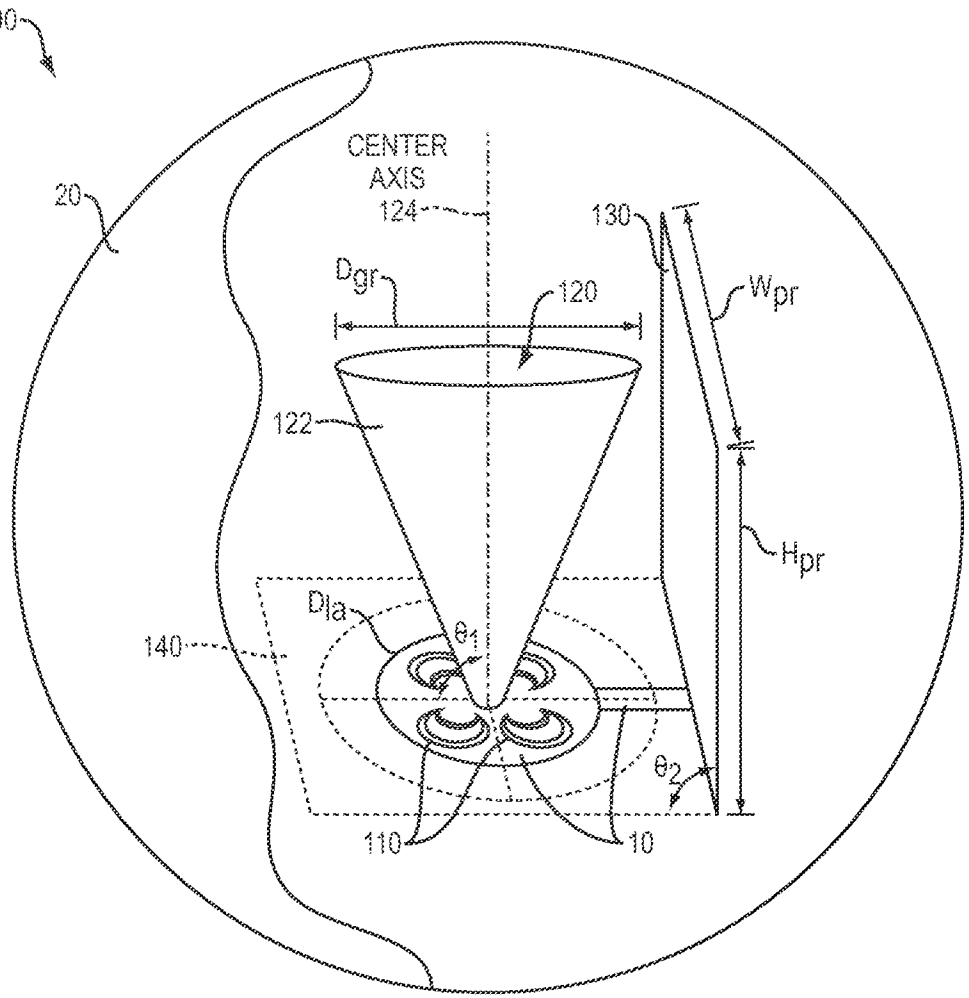
FIG. 1 is a perspective side view of the antenna assembly, with a partial cut away of the antenna assembly housing.
Figure 2:
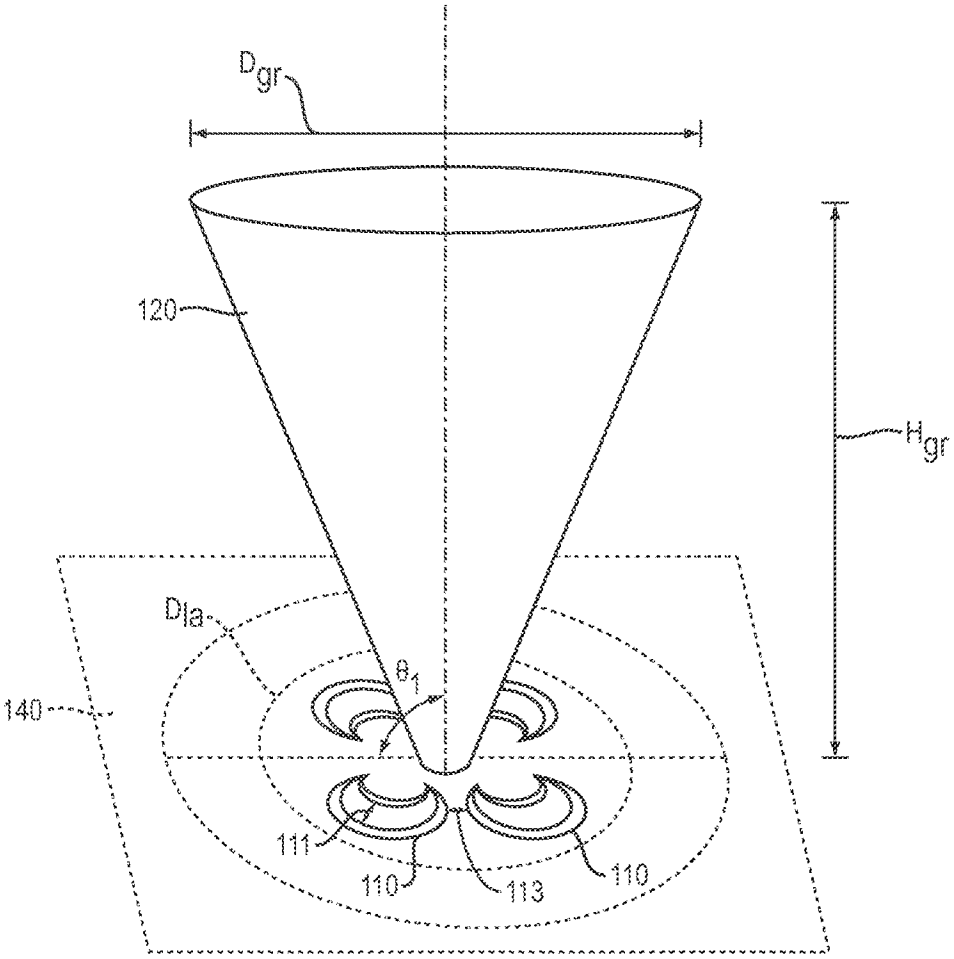
FIG. 2 is more detailed view of an arrangement of loop antennas with respect to a conical reflector of the antenna assembly of FIG. 1, which shows four loop antennas with a centrally disposed conical reflector.

FIGS. 1 and 2 illustrate perspective side views of an antenna assembly 100, where FIG. 2 provides a more detailed view of the arrangement of the antennas and a reflector of the antenna assembly 100. By way of example and not limitation, antenna assembly 100 has a generally planar reflector 130, loop antennas 110, a conical reflector 120, and a transmitter/receiver 160, which can be electrically coupled to the loop antennas 110 to facilitate electromagnetic transmission and/or reception by the loop antennas 110. In some embodiment, the antenna assembly 100 can include one or more support members 10 to support the loop antennas 110 and the reflectors 120 and 130 and can be encompassed by a housing 20 to which the support members are mounted. In some embodiments, the one or more support members 10 can form a substrate. The one or more support members 10 can be configured to align the loop antennas 110, conical reflector 120, and the planar reflector 130 with respect to each other. In an exemplary embodiment, the housing can be spherical.

In an exemplary embodiment, the loop antennas 110 can be arranged in a quadrant configuration such each loop antenna 110 can be generally uniformly spaced with respect to each other circumferentially about a vertical axis extending centrally through the conical reflector 120 to form horizontally oriented loop antennas. The loop antennas 110 can be disposed in proximity to the planar reflector 130 and at an angle $\theta_2$ with respect to the planar reflector 130, as described in more detail below. In some embodiments, the antennas 110 can be disposed and/or configured to be oriented in a coplanar and laterally offset arrangement with respect to each other, e.g., the loop antennas 110 can each be in a plane 140 and can generally have a null zone along an axis that is perpendicular to and aligned with the loop antennas 110. That is, each of the loop antennas 110 can have a transmission null extending perpendicular from the plane of the antenna directly over the respective loop antennas 110.

In some embodiments, each of the loop antennas 110 can generally have a loop dimension that is at least one wavelength of the radiation emitted by the loop antennas 110 and can be spaced less than one wavelength apart from each other. For example, in exemplary embodiments, the loop antennas 110 can emit electromagnetic radiation in a 2.4 gigahertz (GHz) frequency range, a 5.8 GHz frequency range, and/or at any other frequency suitable for propagating or receiving a wireless communications signal to a user device, and the loop dimension and spacing of the antennas 110 with respect to each other can be less than the wavelength of these frequencies. A footprint of the loop antennas 110 can have a diameter $D_{la}$.

In an exemplary embodiment of the present disclosure, the conical reflector 120 can be configured to have a generally cone-shaped configuration. While the conical reflector 120 has a generally coned shaped configuration in the present embodiment, those skilled in the art will recognize that the conical reflector 120 have other shape, such as, for example, pyramidal, bowl (parabolic) shaped, and the like. An apex of the reflector 120 can be disposed in proximity to the loop antennas 110 and a base of the reflector 120 can be disposed away from the loop antennas 110. A contoured surface 122 of the reflector 120 can extend between the apex and the base and about a center axis 124 of the reflector 120. The reflector 120 can have a height $H_{gr}$ and the base of the reflector 120 can have a diameter $D_{gr}$, which can be measured perpendicularly to the loop antennas 110. In some embodiments, the diameter $D_{gr}$ of the base of the reflector 120 can be greater that an exterior diameter $D_{la}$ defined by the loop antennas 110. By providing that the diameter $D_{gr}$ is greater than the exterior diameter $D_{la}$, the reflector 120 can extend over the loop antennas 110 so that electromagnetic radiation that would radiate upwardly into the atmosphere by the loop antennas 110 is reflected towards the earth to increase the presence of radiation below the antenna assembly and away from the antennas 110 to produce a radiation pattern depicted in FIG. 6. The apex of the reflector 120 can be centrally disposed with respect to loop antennas 110 such that, in some embodiments, each of the loop antennas 110 can be uniformly spaced with respect to the apex of the reflector 120.

In an exemplary embodiment, the apex of the reflector 120 can be disposed with respect to the loop antennas 110 so that the reflector 120 is disposed at an angle $\theta_1$ with respect to the plane 140 within which the loop antennas 110 reside. In one embodiment, the reflector 120 can be positioned with respect to the loop antennas 110 so that the center axis of the reflector 120 is approximately perpendicular to the plane 140 of the loop antennas 110 so that the reflector 120 is configured to reflect electromagnetic radiation emitted by the loop antennas 110 downward and outwardly at angle determined by angle of the contoured surface to the loop antennas 110. In some embodiments, the reflector 120 can be disposed with respect to the loop antennas 110 so that the center axis of the reflector 120 has an angle $\theta_1$ that is approximately seventy degrees to approximately one hundred ten degrees with respect to the plane 140 of the loop antennas 110 such that the reflector 120 tilts away from or towards the planar reflector 130. In one exemplary embodiment, the angle $\theta_1$ between the plane 140 of the loop antennas 110 and the center axis can be greater than ninety degrees to increase a distance the reflected radiation emanates outwardly away from the contoured surface of the reflector 120 compared to when the center axis is perpendicular to the plane 140.

The planar reflector 130 can have a height $H_{pr}$ and a width $W_{pr}$ defining a reflective surface of the planar reflector 130. In exemplary embodiments, the planar reflector 130 can extend at the angle $\theta_2$ with respect to the plane 140. In some embodiments, the angle $\theta_2$ can be approximately ninety degrees. In some embodiments, the angle $\theta_2$ can be between forty-five degrees and one hundred and thirty-five degrees. The planar reflector 130 can operate to reflect radiation emanating from the antennas 110 outwardly away from the planar reflector 130. That is, the planar reflector 130 can be configured to provide a reflection plane along the one side of the antenna assembly 100.

Figure 3:
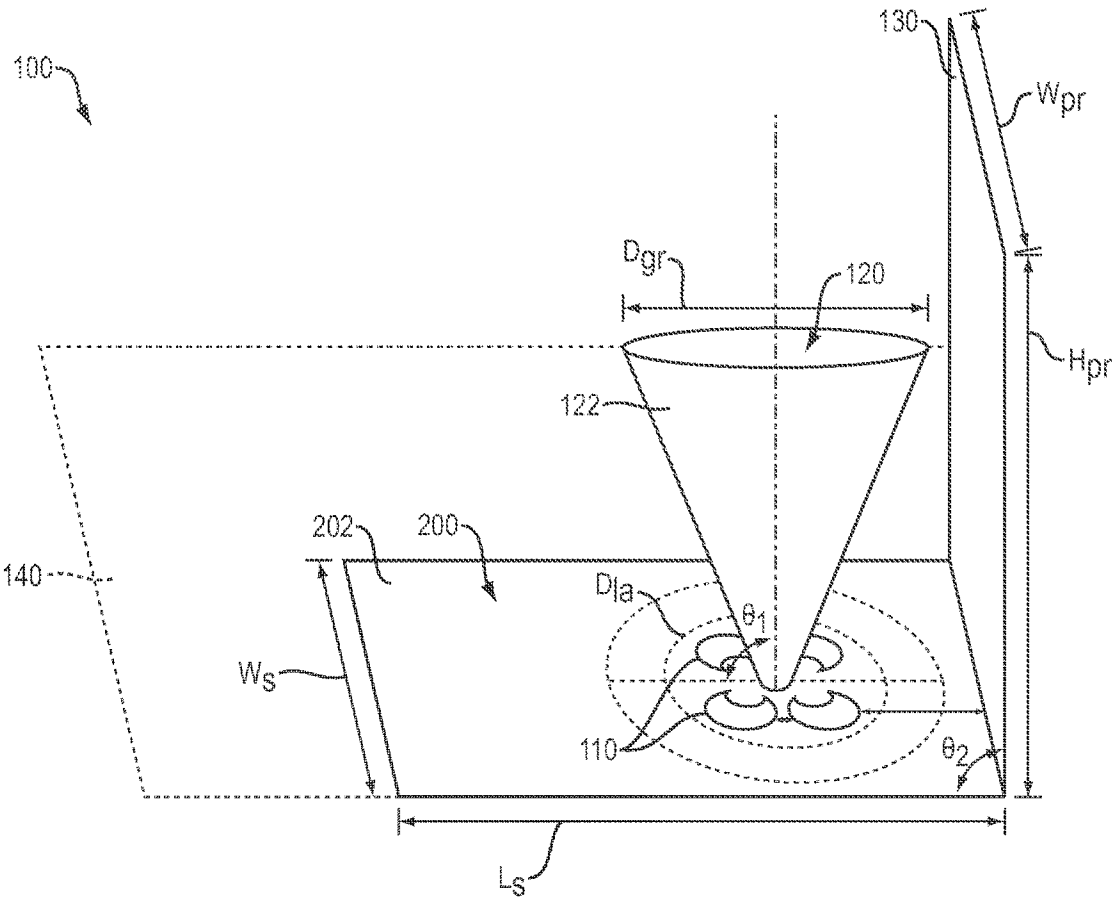
FIG. 3 shows a side perspective view of another embodiment of the antenna assembly, which includes a planar substrate upon which the loop antennas and the reflectors can be mounted.

FIG. 3 shows a side perspective view of another embodiment of the antenna assembly 100, which includes a planar substrate 200 upon which the loop antennas 110, the reflector 120, and the reflector 130 can be mounted. The substrate 200 can include a first surface and an opposing second surface, and a plurality of sides extending between the first and second surfaces. In an exemplary embodiment, substrate 200 can be made of a nonconductive material, such as woven glass reinforced ceramic filled thermoset material and/or any other suitable nonconductive material. A length $L_S$ of the substrate can be measured between opposing first and second sides and a width $W_S$ of the substrate 140 can be measured between the opposing third and fourth sides of the substrate. The length $L_S$ and the width $W_S$ of the substrate 200 define a generally planar surface 202 defining the plane 140 (FIG. 1). The substrate 200 can generally be formed from one or more non-conductive materials that allow electromagnetic radiation to radiate through the substrate 200. In an exemplary embodiment, the substrate 140 can support the loop antennas 110, the conical reflector 120, and the planar reflector 130. The loop antennas 110 can be disposed on the substrate towards the first end and in proximity to the planar reflector 130, which can extend from the first end of the substrate 200 at the angle $\theta_2$. The reflector 120 can be mounted on the substrate 200 to be centrally disposed with respect to the loop antennas 110 and the center axis of the reflector 120 can be disposed at the angle $\theta_1$ with respect to the planar surface 202.

Figure 4:
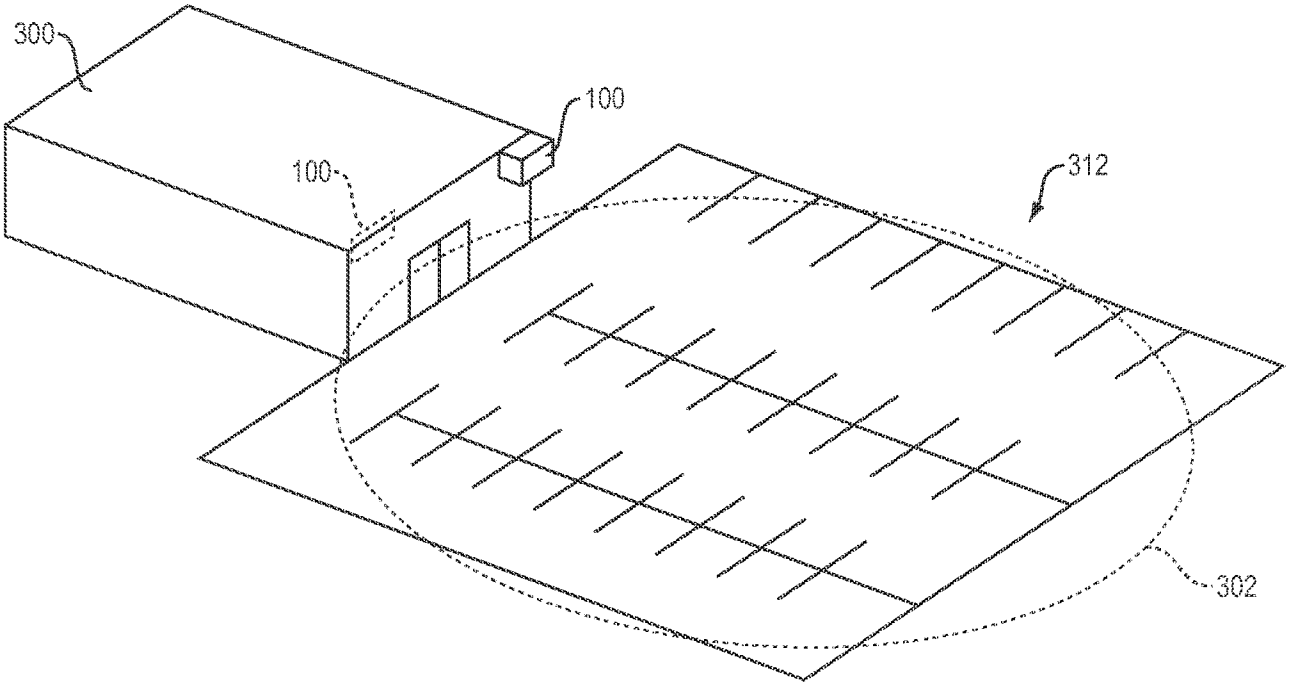
FIG. 4 an antenna system in one embodiment of the present invention, showing an embodiment of the antenna assembly mounted to the upper portion of a building wall with an adjacent parking lot.
Figure 5:
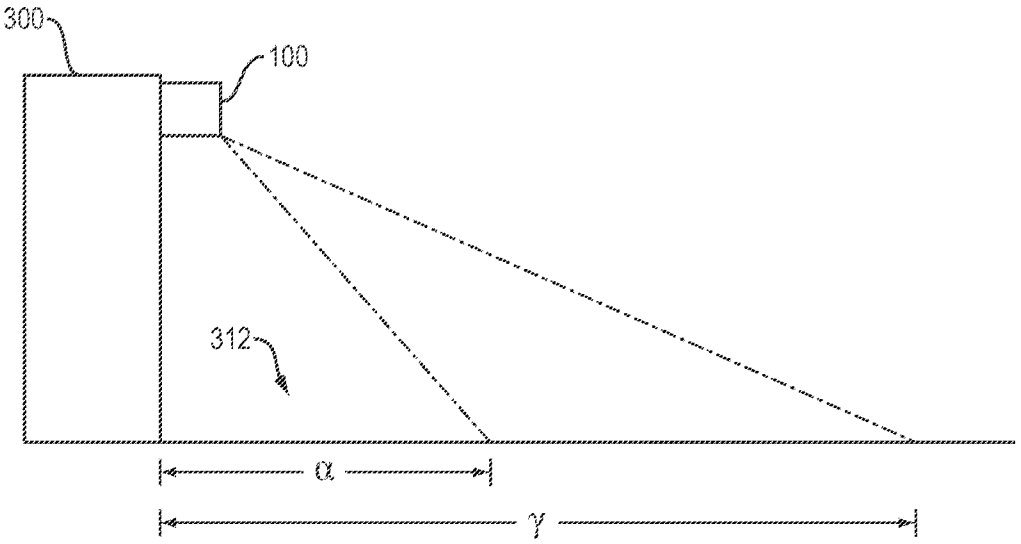
FIG. 5 is a side view of the antenna system of FIG. 1, showing a non-reflected signal coverage area and a reflected signal coverage area.

FIGS. 4 and 5 show an exemplary embodiment of the antenna assembly 100 mounted to an exterior of a building 300. In some embodiments, multiple antenna assemblies 100 can be mounted to the exterior of a building 300. The building 300 can be any building including a store (e.g., a department store, retail store, pharmacy, etc.), an office building, a house, and so on. The antenna assembly 100 can provide a radiation pattern that covers a geographic zone 302 (e.g., a parking lot 312 adjacent to the building. In exemplary embodiments, the first end of the substrate 140 can be mounted in proximity to an exterior to reflect radiation emitted from the loop antennas 110 outwardly away from the building and the reflector 120 can be position above the substrate 140 to reflect radiation emitted from the loop antennas 110 downwardly towards the earth as well as outwardly away from the building 300. In some embodiments, to provide longer coverage distance, the plane of substrate 140 can set at a downward slope (in a direction away from the building) of between 6-10 degrees. Further, the center axis of the reflector 120 can be set at an angle of between 90-100 degrees relative to the substrate 140 to further assist in providing longer wireless coverage distance from the antenna assembly 100, depending on the height of the installation and desired coverage area.

FIG. 5 is a side view of antenna assembly 100, showing a non-reflected signal coverage area $\alpha$ and a reflected signal coverage area $\gamma$. Without conical reflector 120 and planar reflector 130, the radiation pattern from the four loop antennas 110 is concentrated horizontally outward along the axis of the antenna substrate 140 with a null zone located perpendicular to the axis of loop antennas 110 (i.e. directly below the antenna assembly 100). With the inclusion of conical reflector 120 and planar reflector 130, non-reflected area $\alpha$ has a stronger wireless signal strength near antenna system, providing for a total reflected wireless coverage area $\gamma$. As shown, it can be appreciated that it is desirable to have a wireless coverage area $\gamma$ that provides for both near building 300 wireless access as well as wireless access along the periphery of parking lot 312.

Figure 6:
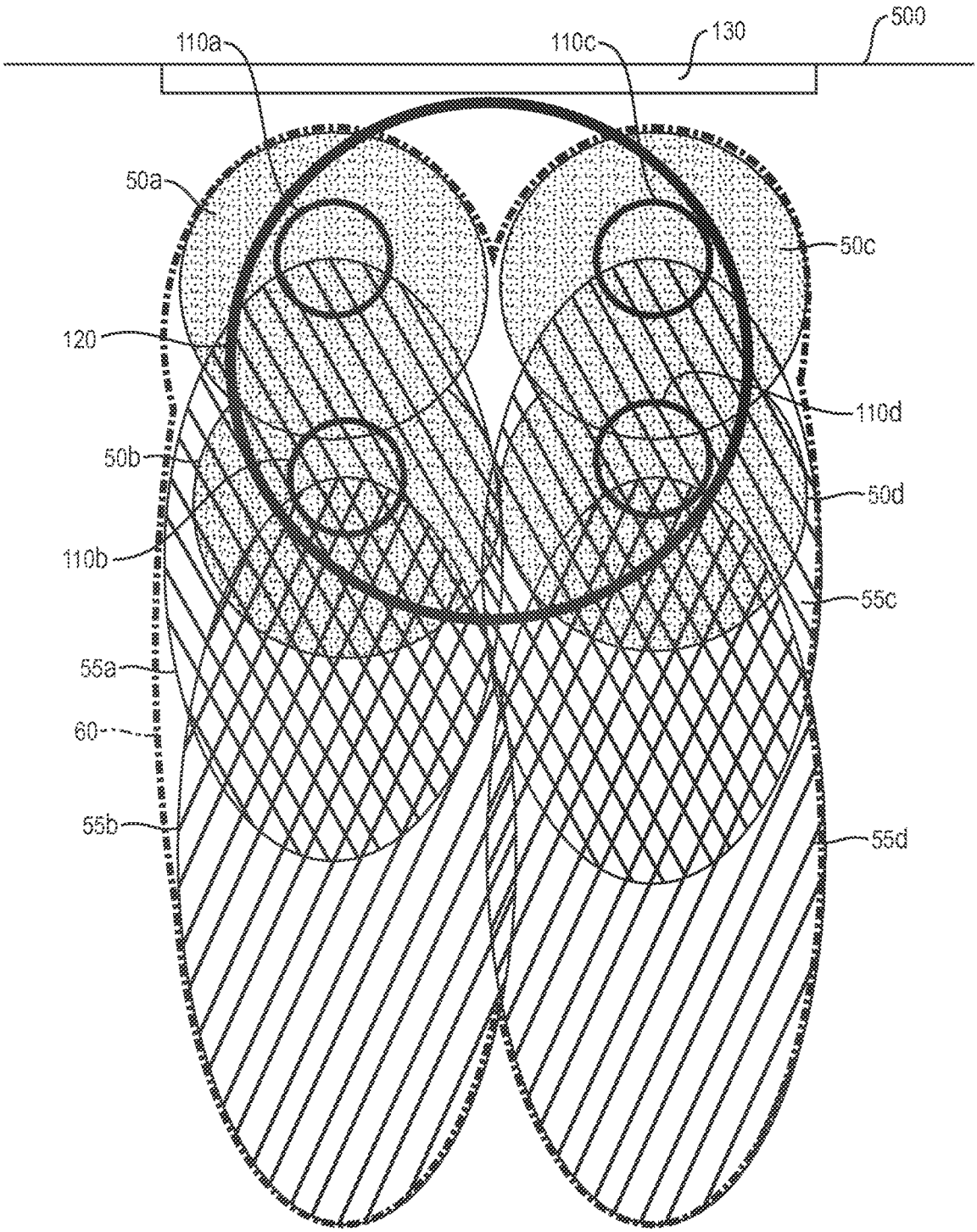
FIG. 6 is a top view of the radiation pattern of the antenna system of FIG. 1, showing a non-reflected signal coverage area and a reflected signal coverage area.

FIG. 6 shows non-reflected signal coverage areas 50A-50D and respective reflected signal coverage areas 55A-55D which radiate from corresponding loop antennas 110A-110D (collectively loop antennas 110), respectively. For example, the loop antenna 110A can generate a non-reflected signal coverage area 50A and a reflected coverage area 55A, the loop antenna 110B can generate a non-reflected signal coverage area 50B and a reflected coverage area 55B, the loop antenna 110C can generate a non-reflected signal coverage area 50C and a reflected coverage area 55C, the loop antenna 110D can generate a non-reflected signal coverage area 50D and a reflected coverage area 55D. As shown in FIG. 5, the non-reflected coverage areas 50A-50D are generally circular, while the reflected coverage area 55-55D are generally elliptical to provide a direction preference to the coverage areas 55A-55D such that the coverage areas 55A-55D extend further away from the loop antennas in one direction (e.g., away from an exterior wall of a building 500) than the coverage areas 50A-50D. In an exemplary embodiment, the wireless frequency transmission is at both the 2.4 GHz and 5.8 GHz frequency spectrum. The loop antennas 110A-110D can be positioned as shown in FIGS. 1-3. A total coverage area generated by the areas 50A-50D and 55A-55D can have a perimeter 60. The antenna assembly can be designed to provide a wireless coverage area which extends out 150 feet along a longitudinal axis $L_C$ of the total coverage area with a signal strength of −72 dBm at 150 feet.

Figure 7:
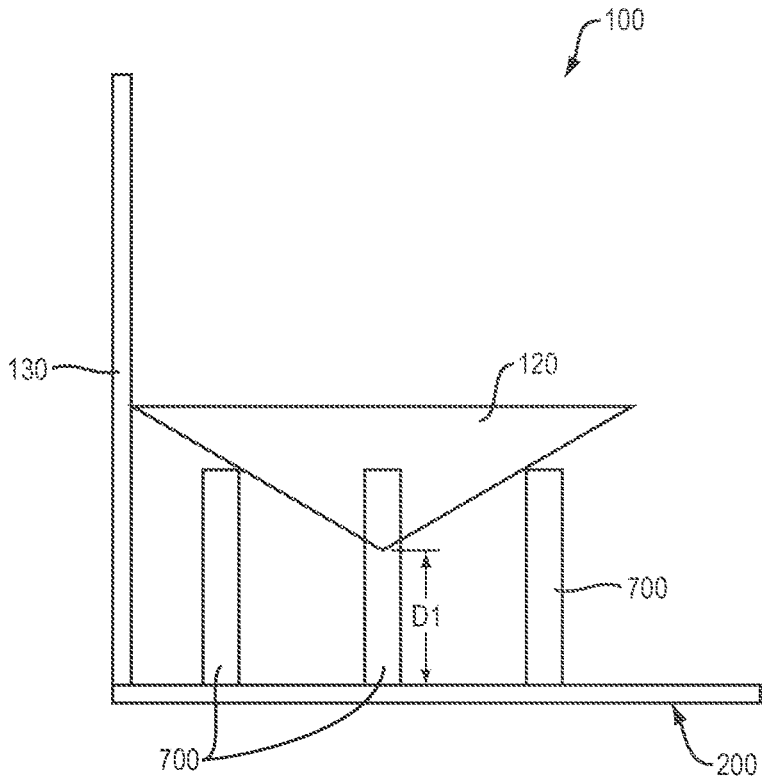
FIG. 7 is a side view of an antenna system in another embodiment of the present invention, showing an embodiment of the conical reflector mounted at a distance separate from the substrate.

FIG. 7 is a side view of another embodiment of the antenna assembly 100. The antenna assembly can include the substrate 200, planar reflector 130, and conical reflector 120. The loop antennas can be disposed on the substrate 200, as shown in FIG. 3. In the present embodiment, the conical reflector 120 can be spaced away from the substrate 200 by one or more support member 700 such that the apex of the conical reflector 120 is a distance $D_1$ away from the substrate 200. In exemplary embodiments, the support members 700 can be formed using a non-conductive material, such as plastic and/or any other suitable non-conductive material. The support members 700 can extend from the substrate 200 to provide a supporting structure onto which the conical reflector 120 can be mounted. In some embodiments, the supporting members 700 can be arranged and/or dimension to mount the conical reflector 120 such that a center axis of the conical reflector 120 is not perpendicular to the plane formed by the substrate surface. For these embodiments, depending on the angle of conical reflector 120 selected, the apex of conical reflector 120, and the conical reflector 120 itself can be positioned above substrate 200 at the distance $D_1$ to provide a specified spatial relationship between the loop antennas disposed in the substrate 200 and the conical surface of the conical reflector 120 to facilitate reflection of the radiation emitted by the loop antennas and form a specified coverage area. In some embodiments, the conical reflector 120 can be mounted, attached, and/or supported by connection to an interior surface of a housing within which the conical reflector is encapsulated (e.g. housing 20 of FIG. 1).

FIGS. 8A-8F illustrate an antenna assembly 800. By way of example and not limitation, the antenna assembly 800 includes a housing 801 including a cover 802 fastenable to a mounting bracket 803 to define an interior volume thereof. The antenna assembly 800 also includes a planar substrate 805 positioned within the cover 802 and having a plurality of radiating elements 810 defined in a uniformly spaced arrangement thereon. The antenna assembly 800 also includes a first reflector 820 having an inverted, truncated, semi-circular conical configuration, the first reflector 820 positioned within the cover 802 and spaced apart from the radiating elements 810. In accordance with various embodiments, the cover 802 of the antenna assembly 800 can include one or more support elements 804 to support the planar substrate 805 and the first reflector 820. In accordance with various embodiments, the cover 802 can be a truncated semi-sphere. In accordance with various embodiments the mounting bracket 803 can include a second reflector 830 on an interior surface thereof.

Figure 8A:
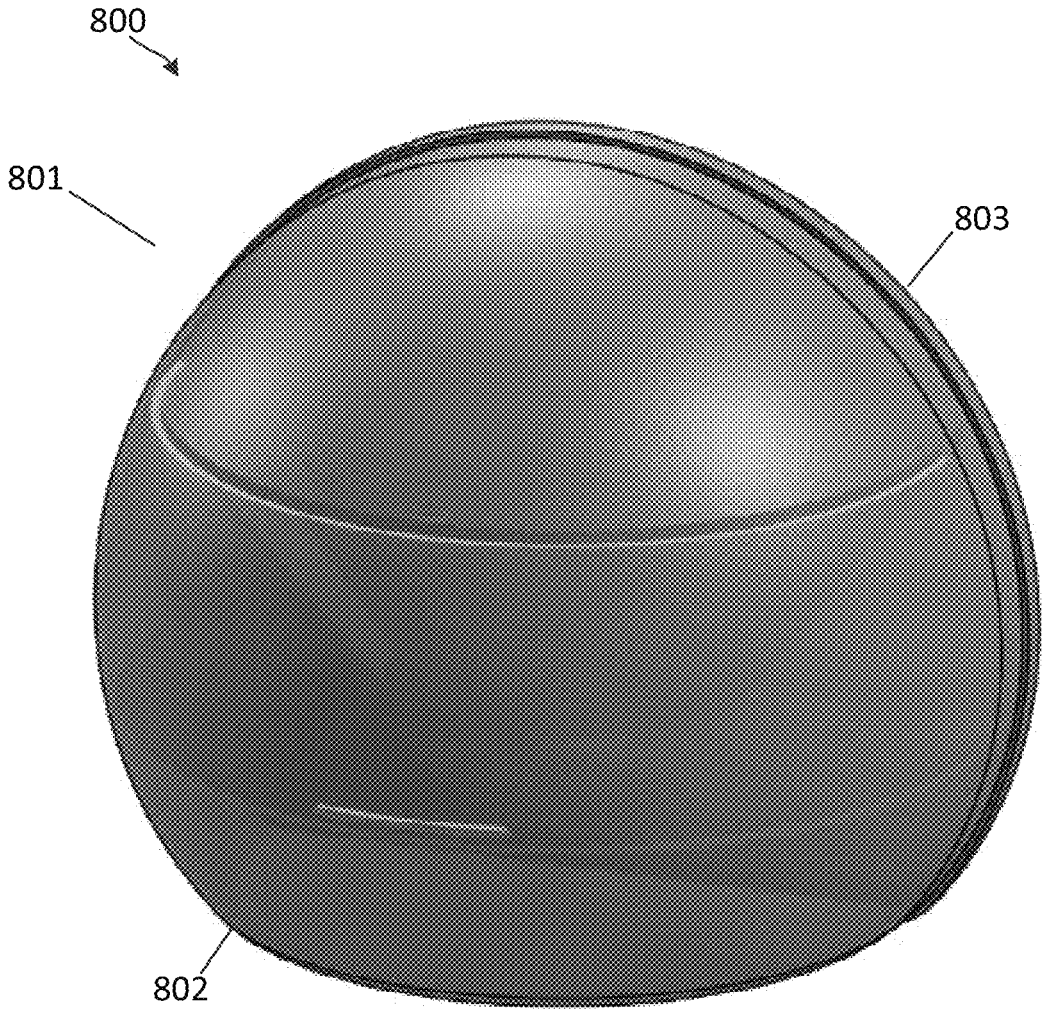
FIG. 8A is an external perspective view of an alternative antenna assembly.
Figure 8B:
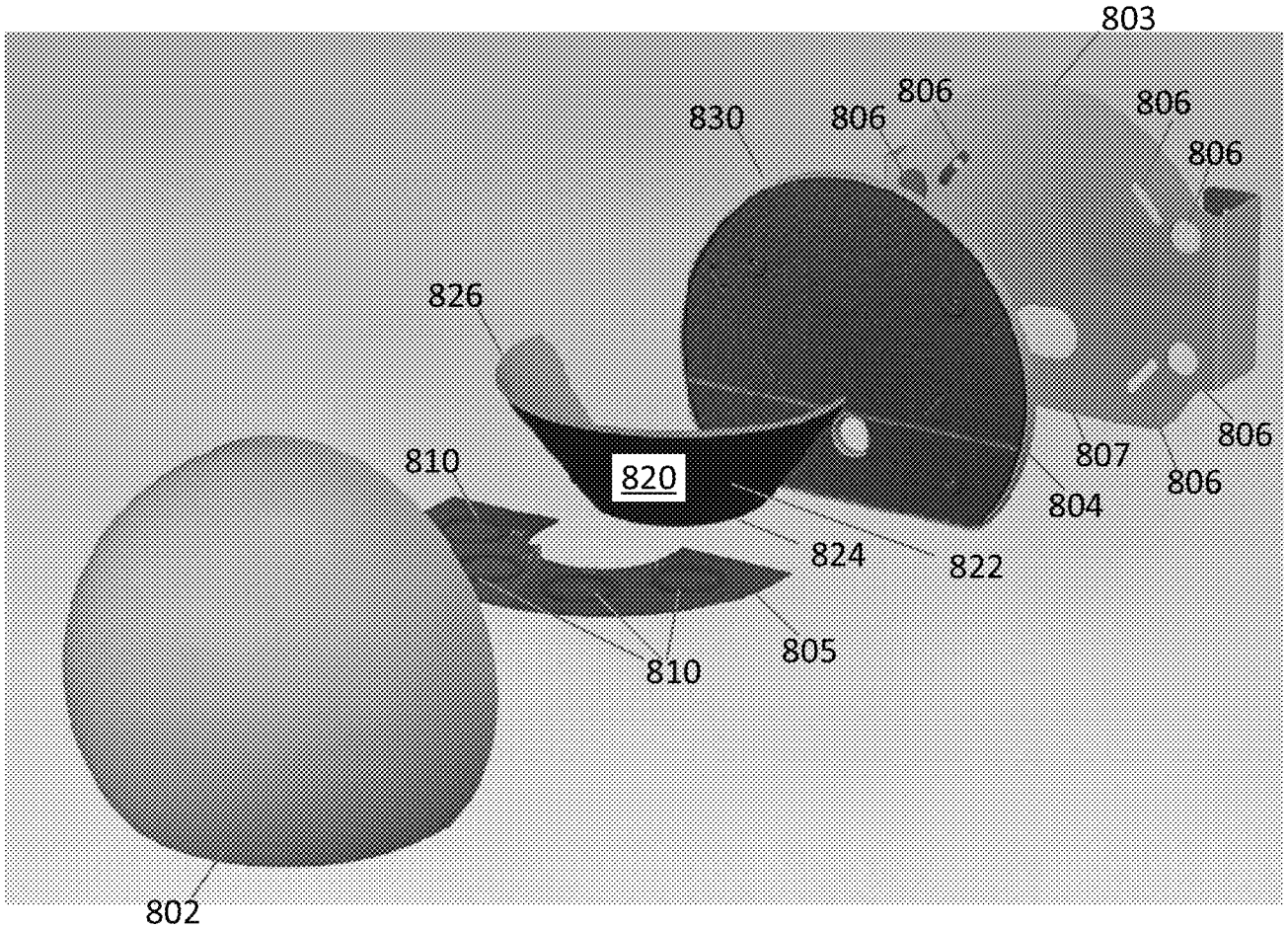
FIG. 8B is an exploded perspective view showing the components of the alternative antenna assembly of FIG. 8A.
Figure 8C:
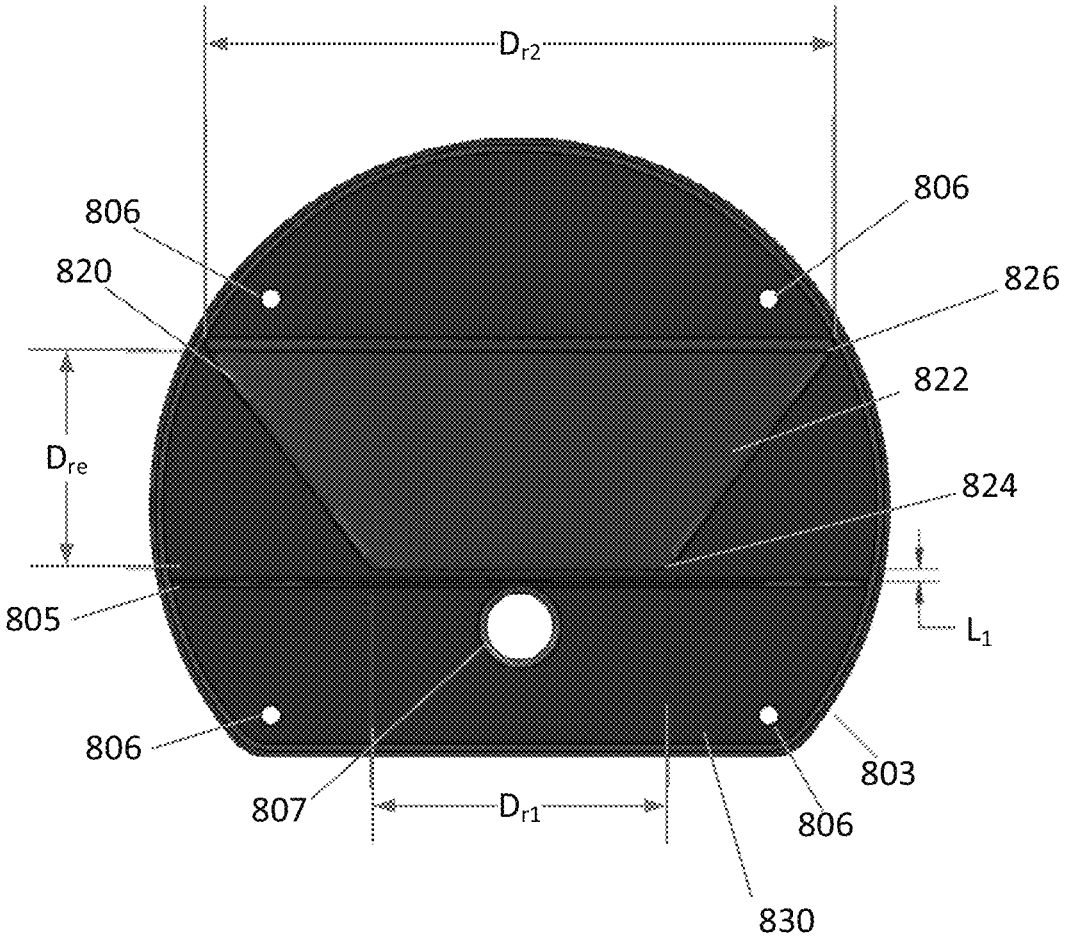
FIG. 8C is a front view of the alternative antenna assembly of FIG. 8A with the cover removed.
Figure 8D:
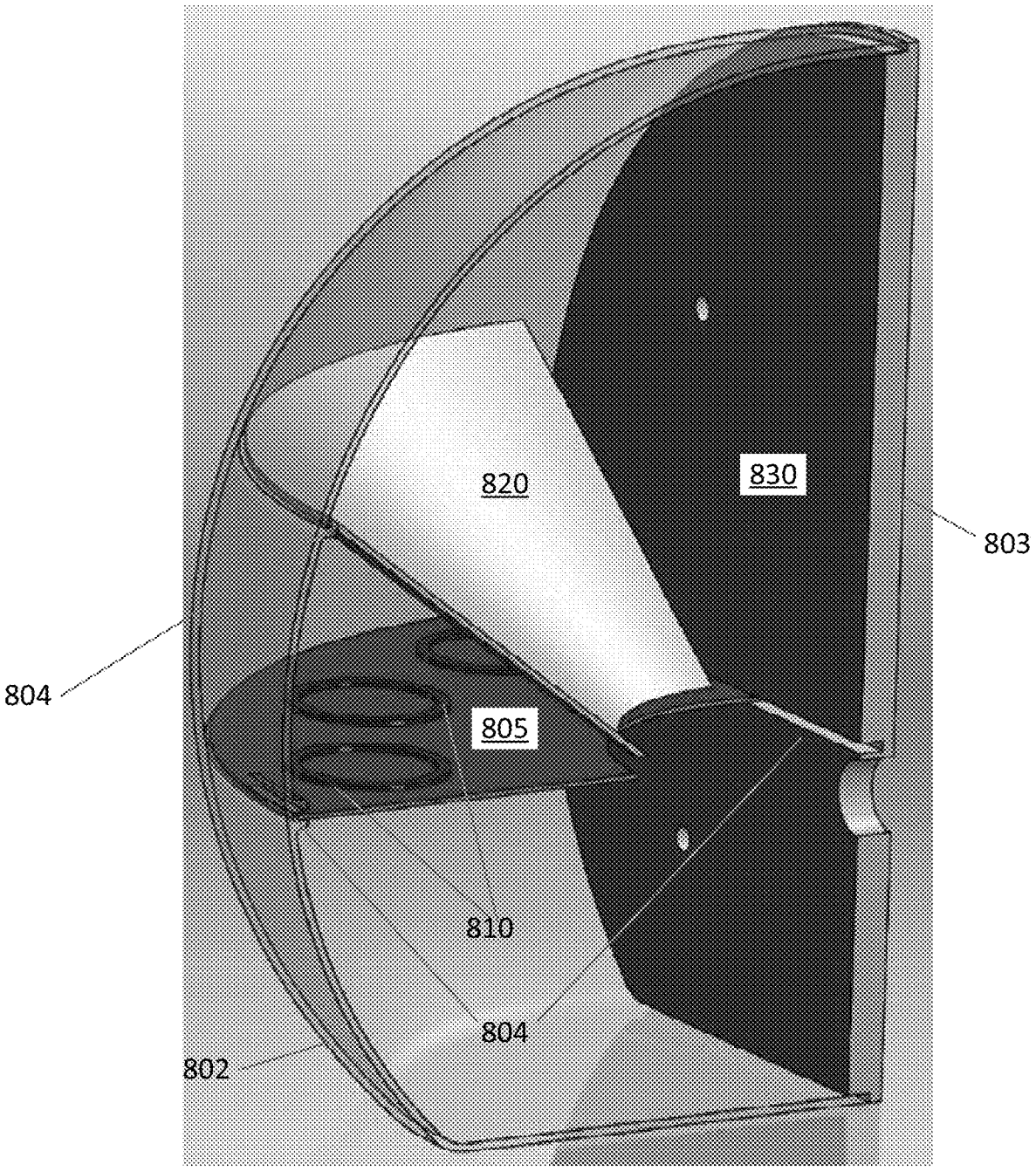
FIG. 8D is a cross-sectional perspective view of the alternative antenna assembly of FIG. 8A.
Figure 8E:
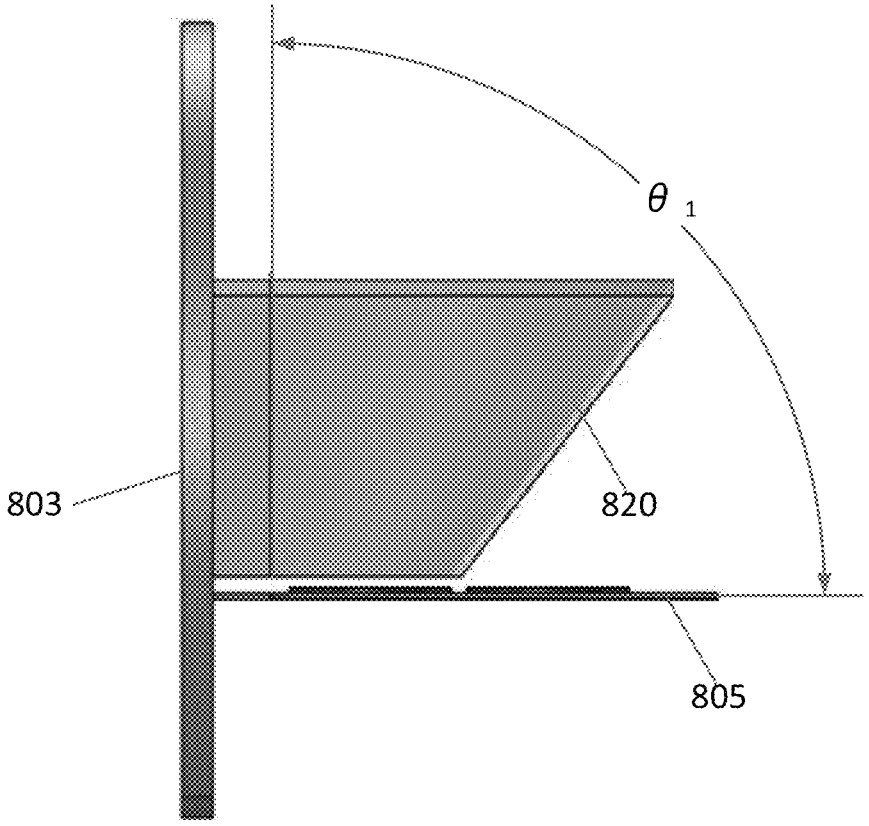
FIG. 8E is an interior side view of the alternative antenna assembly of FIG. 8A with the cover removed.
Figure 8F:
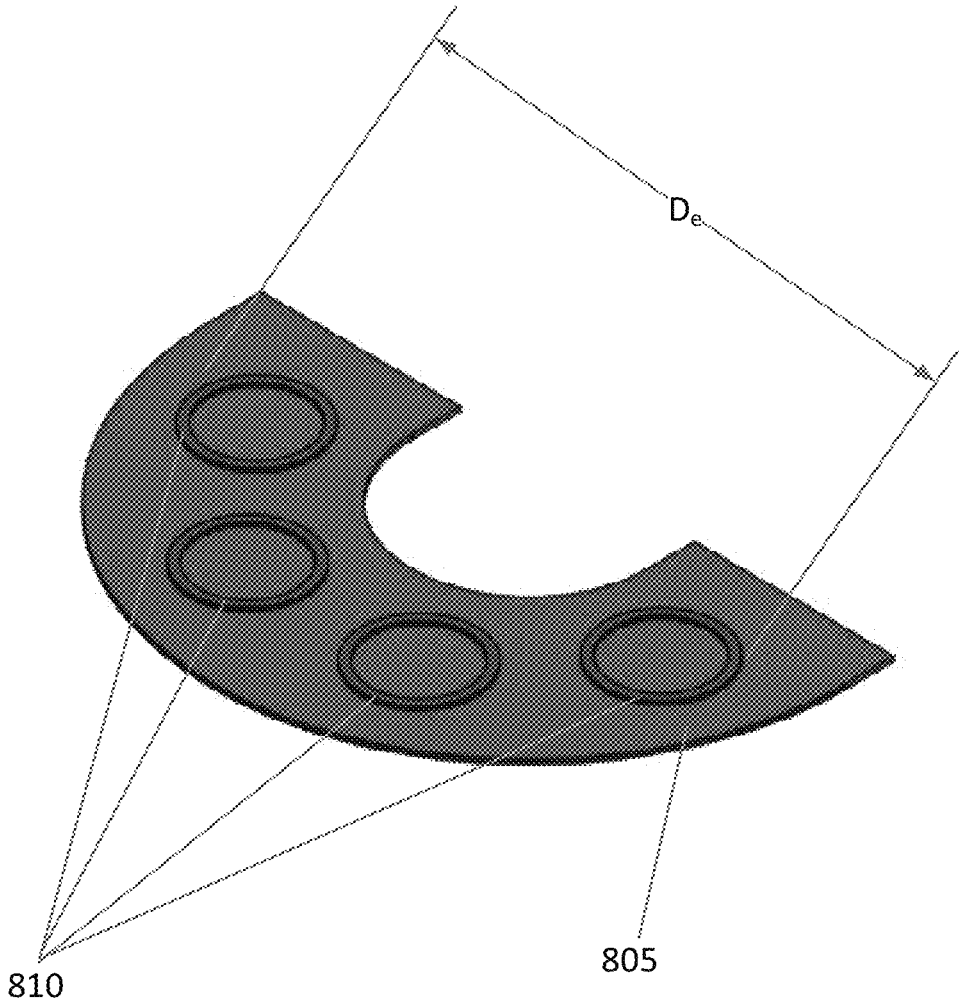
FIG. 8F is a perspective view of a common plane of the alternative antenna assembly of FIG. 8A having four radiation elements aligned thereon.

The housing 801 includes a cover 802 fastenable to a mounting bracket 803 to define an interior volume thereof. The cover 802 can be constructed of any suitable transmissive material, including, for example, plastics, polymers, composites, foam, glass, or any other suitable transmissive material. Although the cover 802 is shown in FIGS. 8A-8F as having a truncated, semi-spherical configuration, it will be apparent in view of this disclosure that any suitable configuration can be used, including, for example, cubes, rectangular prisms, spheres, geodesic domes, etc. The mounting bracket 803 can be constructed of any suitable material including, for example, wood, metal, plastics, polymers, composites, or any other suitable material. As shown in FIGS. 8B-8D, the mounting bracket 803, in accordance with various embodiments, can include a plurality of mounting apertures 806 for mounting the assembly 800 to a mounting location (e.g., a post, wall, or other location) and/or the cover 802. Further as shown in FIGS. 8B-8D, the mounting bracket 803, in accordance with various embodiments, can include one or more ingress/egress holes 807 for permitting ingress/egress to the assembly 800 by one or more wires (e.g., for power supply or signal relay).

In accordance with various embodiments, at least one of the cover 802, the mounting bracket 803, or the second reflector 830 can include one or more support elements 804 for retaining, supporting or connecting to one or more of the substrate 805 and the first reflector 820. As shown, for example, in FIG. 8D, such support elements 804 can be any suitable element, including, for example, recessed channels (e.g., as shown at the interaction point between the second reflector 830 and the substrate 805), protruding lips (e.g., as shown at the interaction point between the cover 802 and the first reflector 820), or protruding channels (e.g., as shown at the interaction point between the cover 802 and the substrate 805). In accordance with various embodiments, the support elements 804 can be formed integrally with the cover 802, second reflector 830, or mounting bracket 803. In accordance with various embodiments, the support elements 804 can be attached or fastened to the cover 802, second reflector 830, or mounting bracket 803.

In an exemplary embodiment, the radiant elements 810 can be aligned on the planar substrate 805 and can be generally uniformly spaced with respect to each other semi-circumferentially about an axis perpendicular to the planar substrate 805 extending centrally through a diameter line of a semi-circle formed on the planar substrate 805 by the radiating elements 810. The planar substrate 805 can be attached in perpendicular arrangement to the mounting bracket 803 as described in more detail below. In some embodiments, the radiant elements 810 can be disposed and/or configured to be oriented in a coplanar and laterally offset arrangement with respect to each other, e.g., the radiant elements 810 can be loop antennas as shown and can each be in a plane (e.g., a common plane defined by the planar substrate 805) and can generally have a null zone along an axis that is perpendicular to and aligned with the radiant elements 810. That is, each of the radiant elements 810 can have a transmission null extending perpendicular from the common plane directly over the respective radiant elements 810.

Figure 9A:
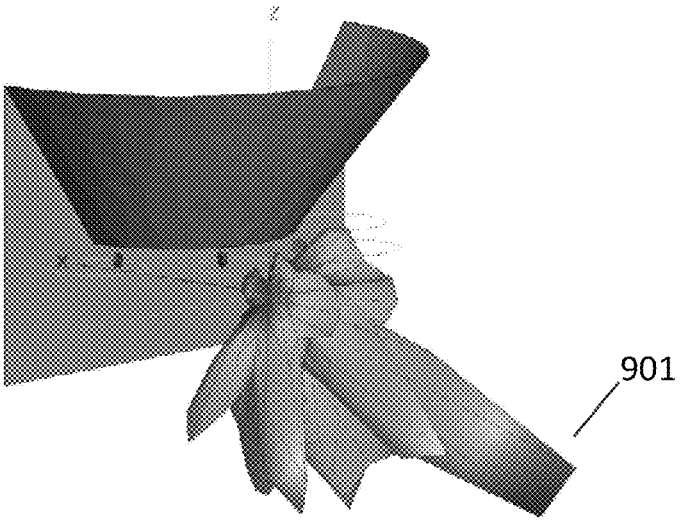
FIGS. 9A and 9B are left and right hand views of the alternative antenna system of FIG. 8A, showing the reflected radiation pattern of the antenna assembly when the radiation elements are emitting radiation at 5.8 GHz.
Figure 9B:
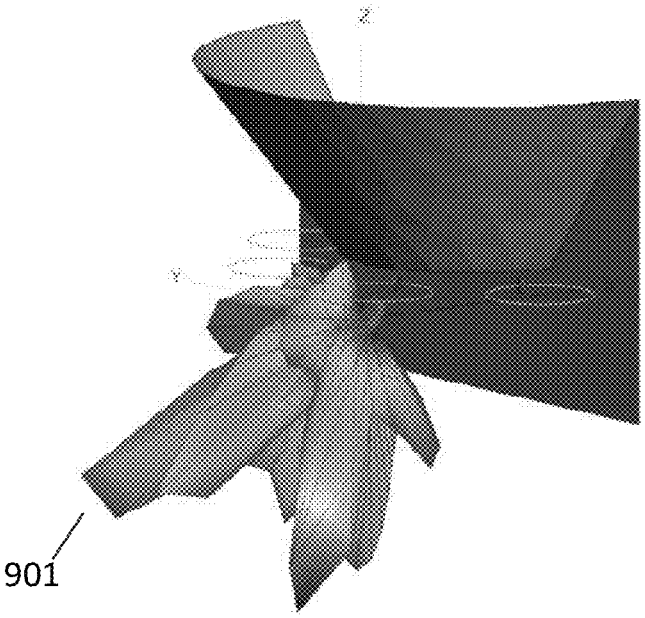
Figure 10B:
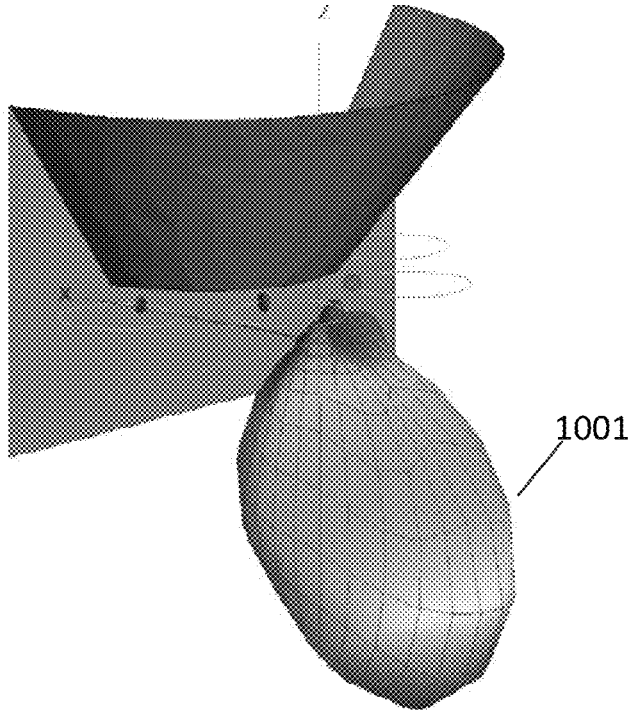
FIGS. 10A and 10B are left and right hand views of the alternative antenna system of FIG. 8A, showing the reflected radiation pattern of the antenna assembly when the radiation elements are emitting radiation at 2.4 GHz.
Figure 10A:
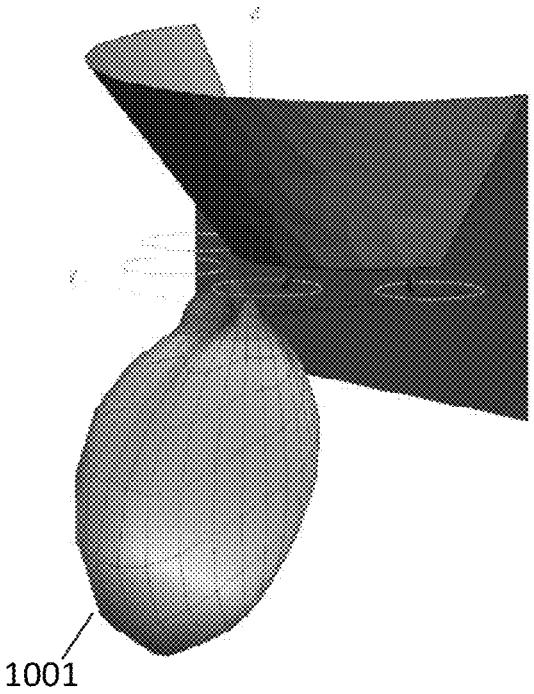

In some embodiments, wherein the radiant elements 810 are loop antennas, each of the radiant elements 810 can generally have a loop dimension that is at least one wavelength of the radiation emitted by the radiant elements 810 and can be spaced less than one wavelength apart from each other. For example, in exemplary embodiments, the radiant elements 810 (e.g., loop antennas as shown) can emit electromagnetic radiation in a 2.4 gigahertz (GHz) frequency range as shown in FIGS. 10A and 10B, a 5.8 GHz frequency range as shown in FIGS. 9A and 9B, and/or at any other frequency suitable for propagating or receiving a wireless communications signal to a user device, and the loop dimension and spacing of the radiant elements 810 with respect to each other can be less than the wavelength of these frequencies. A footprint of the radiant elements 810 can have an outer diameter $D_e$.

In an exemplary embodiment of the present disclosure, the first reflector 820 can be configured to have a generally cone-shaped configuration. In particular, the first reflector 820, as shown in FIGS. 8A-8F, is configured to have an inverted, truncated, semi-circular conical configuration. While the first reflector 820 has an inverted, truncated, semi-circular conical configuration in the present embodiment, those skilled in the art will recognize that the first reflector 820 can, in accordance with various embodiments, have one or more other shapes, such as, for example, conical, pyramidal, bowl (parabolic) shaped, and the like. A first base 824 of the reflector 820 can be spaced apart from and disposed in proximity to the radiant elements 810 and a second base 826 of the reflector 820 can be disposed away from the radiant elements 810. A contoured surface 822 of the reflector 820 can extend between the first base 824 and the second base 826 and about a center axis 124 of the reflector 820. The reflector 820 can have a height $H_r$, the first base 824 can have a diameter $D_{r1}$, and the second base 826 can have a diameter $D_{r2}$. In some embodiments, the diameter $D_{r2}$ of the second base 826 of the reflector 820 can be greater than the footprint outer diameter $D_e$ defined by the radiant elements 810. By providing that the diameter $D_{r2}$ is greater than the footprint outer diameter $D_e$, the reflector 820 can extend over the radiant elements 810 so that electromagnetic radiation that would radiate upwardly into the atmosphere by the radiant elements 810 is reflected towards the earth to increase the presence of radiation below the antenna assembly and away from the radiant elements 810 to produce a radiation pattern depicted in FIGS. 9A-10B. The first base 824 of the reflector 820 can be concentrically disposed with respect to radiant elements 810 such that, in some embodiments, each of the radiant elements 810 can be uniformly spaced with respect to the first base 824 of the reflector 820.

In an exemplary embodiment, the first base 824 of the reflector 820 can be disposed with respect to the radiant elements 810 so that the reflector 820 is disposed at an angle $\theta_1$ with respect to the planar substrate 805 within which the radiant elements 810 reside. In one embodiment, the reflector 820 can be positioned with respect to the radiant elements 810 so that the center axis of the reflector 820 is approximately perpendicular to the planar substrate 805 of the radiant elements 810 so that the reflector 820 is configured to reflect electromagnetic radiation emitted by the radiant elements 810 downward and outwardly at angle determined by angle of the contoured surface to the radiant elements 810. In some embodiments, the reflector 820 can be disposed with respect to the radiant elements 810 so that the center axis of the reflector 820 has an angle $\theta_1$ that is approximately seventy degrees to approximately one hundred ten degrees with respect to the planar substrate 805 of the radiant elements 810 such that the reflector 820 tilts away from or towards the second reflector 830. In one exemplary embodiment, the angle $\theta_1$ between the planar substrate 805 of the radiant elements 810 and the center axis can be greater than ninety degrees to increase a distance the reflected radiation emanates outwardly away from the contoured surface of the reflector 820 compared to when the center axis is perpendicular to the planar substrate 805.

The second reflector 830 can be formed on or fastened to an inner surface of the mounting bracket 803. In exemplary embodiments, a reflective surface of the second reflector 830 can extend at an angle with respect to the planar substrate 805. In some embodiments, the angle can be approximately ninety degrees. In some embodiments, the angle can be between forty-five degrees and one hundred and thirty-five degrees. The second reflector 830 can operate to reflect radiation emanating from the radiant elements 810 outwardly away from the second reflector 830. That is, the second reflector 830 can be configured to provide a reflection plane along one side (e.g., the back side as shown) of the antenna assembly 800.

In accordance with various embodiments, the first reflector 820 can be spaced away from the substrate 805 by interaction with the one or more support elements 804 such that the first base 824 of the first reflector 820 is a distance $L_1$ away from the substrate 805. The support elements 804 can extend from the cover 802 or the mounting bracket 803 of the housing 801 to provide a supporting structure onto which the first reflector 820 can be mounted. In some embodiments, the supporting elements 804 can be arranged and/or dimensioned to mount the first reflector 820 such that a center axis of the first reflector 820 is not perpendicular to the plane formed by the substrate surface. For these embodiments, depending on the angle of first reflector 820 selected, the first base 824 of first reflector 820, and the first reflector 820 itself can be positioned above substrate 805 at the distance $L_1$ to provide a specified spatial relationship between the radiant elements 810 disposed in the substrate 805 and the conical surface of the first reflector 820 to facilitate reflection of the radiation emitted by the radiant elements 810 and form a specified coverage area. In some embodiments, the first reflector 820 can be mounted, attached, and/or supported by connection to at least one of the cover 802, the second reflector 830, or the mounting bracket 803 within which the first reflector 820 is encapsulated.

FIGS. 9A-9B illustrate a radiation pattern 901 generated by the antenna assembly 800 of FIGS. 8A-8F when the radiant elements 810 are emitting electromagnetic radiation in a 5.8 gigahertz (GHz) frequency range. FIGS. 10A-10B illustrate a radiation pattern 1001 generated by the antenna assembly 800 of FIGS. 8A-8F when the radiant elements 810 are emitting electromagnetic radiation in a 2.4 gigahertz (GHz) frequency range. As shown in FIGS. 9A-10B, the radiation patterns 901, 1001 are projected both downward and outward, thereby advantageously eliminating the above-described null zone associated with each of the radiant elements 810 along the axis perpendicular to and aligned with the radiant elements 810.

It will be apparent to those skilled in the art that, while the invention has been illustrated and described herein in accordance with the patent statutes, modification and changes may be made in the disclosed embodiments without departing from the true spirit and scope of the invention. It is, therefore, to be understood that the appended claims are intended to cover all such modifications and changes as fall within the true spirit of the invention.

We claim:

1. A method for compensating for a null in electromagnetic radiation from an antenna assembly comprising:

aligning a plurality of radiation elements in a common plane, the plurality of radiation elements being uniformly spaced with respect to each other semi-circumferentially about an axis perpendicular to the common plane extending centrally through a diameter line of a semi-circle formed on the common plane by the radiating elements;

forming a first reflector to have an inverted, truncated, semi-spherical conical configuration;

positioning the first reflector centrally with respect to the diameter line of the semi-circle formed on the common plane by the radiation elements;

spacing the first base of the first reflector to be in proximity to the radiating elements, a second base of the first reflector being disposed further away from the radiation elements than the first base, wherein the second base of the first reflector has a diameter that exceeds a footprint formed by the radiating elements;

positioning a second reflector relative to the common plane, the second reflector extending at an angle other than ninety degrees with respect to the common plane; and reflecting electromagnetic radiation emitted by the radiation elements along the axis and through the common plane by the first reflector to provide a coverage area that extends along the axis beyond the antenna assembly.

2. The method of claim 1, wherein a center axis of the first reflector corresponds to the axis perpendicular to the common plane.

3. The method of claim 1, wherein a center axis of the first reflector extends at an angle to the common plane other than ninety degrees.

4. The method of claim 1, wherein the second reflector extends through the common plane and defines a planar reflection surface.

5. The method of claim 4, wherein the second reflector is disposed adjacent to the first reflector.

6. The method of claim 4, wherein the second reflector intersects the common plane at an intersection of the common plane and the axis perpendicular to the common plane.

7. The method of claim 1, wherein the each of the radiating elements is a single feedpoint loop antenna.

8. The method of claim 1, further comprising:

forming a housing that encloses the plurality of radiation elements and the first reflector.

9. The method of claim 8, wherein the housing includes a cover constructed of transmissive material and a mounting bracket attached to the cover, wherein the mounting bracket and the cover define an interior volume of the housing for enclosing the plurality of radiation elements and the first reflector.

10. The method of claim 9, wherein the cover has a truncated, semi-spherical configuration.

11. The method of claim 9, wherein the housing includes at least one support element configured to maintain a position of the plurality of radiation elements within the interior volume.

12. The method of claim 9, wherein the housing includes at least one support element configured to maintain a position of the first reflector within the interior volume.

13. The method of claim 9, wherein the mounting bracket defines at least one aperture configured to permit wiring ingress to the housing.

14. The method of claim 1, wherein the plurality of radiation elements are defined on a printed circuit board.

15. The method of claim 14, wherein the printed circuit board has a semi annular configuration.

16. A method for compensating for a null in electromagnetic radiation from an antenna assembly comprising:

aligning a plurality of radiation elements in a common plane, the plurality of radiation elements being uniformly spaced with respect to each other semi-circumferentially about an axis perpendicular to the common plane extending centrally through a diameter line of a semi-circle formed on the common plane by the radiating elements;

forming a first reflector to have an inverted, truncated, semi-spherical conical configuration;

positioning a first reflector centrally with respect to the diameter line of the semi-circle formed on the common plane by the radiation elements;

spacing a first base of the first reflector in proximity to the radiating elements, a second base of the first reflector being disposed further away from the radiation elements than the first base, wherein the second base of the first reflector has a diameter that exceeds a footprint of the radiating elements;

positioning a second reflector relative to the common plane, the second reflector extending at an angle perpendicular to the common plane; and reflecting electromagnetic radiation emitted by the radiation elements along the axis and through the common plane by the first reflector to provide a coverage area that extends along the axis beyond the antenna assembly.

17. The method of claim 16, wherein a center axis of the first reflector corresponds to the axis perpendicular to the common plane.

18. The method of claim 16, wherein a center axis of the first reflector extends at an angle to the common plane other than ninety degrees.

19. The method of claim 16, wherein the second reflector extends through the common plane and defines a planar reflection surface.

20. The method of claim 19, wherein the second reflector is disposed adjacent to the first reflector.

21. A method for compensating for a null in electromagnetic radiation from an antenna assembly comprising:

aligning a plurality of radiation elements in a common plane, the plurality of radiation elements being uniformly spaced with respect to each other semi-circumferentially about an axis perpendicular to the common plane extending centrally through a diameter line of a semi-circle formed on the common plane by the radiating elements;

forming a first reflector to have an inverted, truncated, semi-spherical conical configuration;

positioning a first reflector centrally with respect to the diameter line of the semi-circle formed on the common plane by the radiation elements;

spacing a first base of the first reflector in proximity to the radiating elements, a second base of the first reflector being disposed further away from the radiation elements than the first base, wherein the second base of the first reflector has a diameter that exceeds a footprint of the radiating elements;

positioning a second reflector adjacent to the first reflector; and reflecting electromagnetic radiation emitted by the radiation elements along the axis and through the common plane by the first reflector to provide a coverage area that extends along the axis beyond the antenna assembly.

* * * * *